US009735458B2

(12) United States Patent
Sasaki et al.

(10) Patent No.: US 9,735,458 B2
(45) Date of Patent: Aug. 15, 2017

(54) NON-RECIPROCAL CIRCUIT DEVICE AND COMMUNICATION APPARATUS USING THE SAME

(71) Applicant: TDK Corporation, Tokyo (JP)

(72) Inventors: Hideyuki Sasaki, Tokyo (JP); Minoru Sakai, Tokyo (JP)

(73) Assignee: TDK CORPORATION, Tokyo (JP)

( * ) Notice: Subject to any disclaimer, the term of this patent is extended or adjusted under 35 U.S.C. 154(b) by 72 days.

(21) Appl. No.: 15/048,724

(22) Filed: Feb. 19, 2016

(65) Prior Publication Data

US 2016/0254581 A1 Sep. 1, 2016

(30) Foreign Application Priority Data

Feb. 27, 2015 (JP) ..... 2015-038067

(51) Int. Cl.
*H01P 1/387* (2006.01)

(52) U.S. Cl.
CPC ..... *H01P 1/387* (2013.01)

(58) Field of Classification Search
CPC ..... H01P 1/38; H01P 1/387; H01P 1/383
USPC ..... 333/1.1, 24.2
See application file for complete search history.

(56) References Cited

U.S. PATENT DOCUMENTS

2009/0322440 A1* 12/2009 Inglis ..... H01P 1/387 333/1.1
2015/0028961 A1* 1/2015 Carr ..... H01P 1/387 333/1.1

FOREIGN PATENT DOCUMENTS

JP H09-121104 A 5/1997

* cited by examiner

*Primary Examiner* — Stephen E Jones
(74) *Attorney, Agent, or Firm* — Young Law Firm, P.C.

(57) ABSTRACT

Disclosed herein is a non-reciprocal circuit device includes: a substrates including a magnetic plate having a circular surface and a dielectric ring having an annular surface, the circular surface and the annular surface being substantially coplanar; a center conductor disposed on the substrates; and a permanent magnet that applies a magnetic field to the center conductor. The center conductor includes: a main conductor portion positioned on a straight line extending from a center of the circular surface to an outer periphery of the annular surface; and a branched conductor portion extending in a radial direction of the substrate from the center of the circular surface. The branched conductor portion includes: a wide portion disposed on the circular surface; and a narrow portion having a width smaller than that of the wide portion and disposed across a boundary between the circular surface and the annular surface.

7 Claims, 11 Drawing Sheets

NON-RECIPROCAL CIRCUIT DEVICE AND COMMUNICATION APPARATUS USING THE SAME

BACKGROUND OF THE INVENTION

Field of the Invention

The present invention relates to a non-reciprocal circuit device and a communication apparatus using the same and, more particularly, to a non-reciprocal circuit device of a distributed constant type and a communication apparatus using the same.

Description of Related Art

A non-reciprocal circuit device such as an isolator or a circulator is incorporated in, for example, a mobile communication apparatus like a mobile phone or a communication apparatus used in a base station. The non-reciprocal circuit devices can be classified into a distribution constant type, a concentrated constant type, and the like. Among them, the non-reciprocal circuit device of the distribution constant type is suitable for use in a base station and the like where high power output signal is required.

A structure of the distribution constant type non-reciprocal circuit device is described in, e.g., Japanese Patent Application Laid-Open No. 1997-121104. The non-reciprocal circuit device described in Japanese Patent Application Laid-Open No. 1997-121104 has a center conductor including three conductors (main conductor portions) extending radially at an angular interval of 120° and three electrode portions (branched conductor portions) extending radially from the roots of the main conductor portions at an angular interval of 120°. This center conductor is placed on a substrate. The substrate is an integrated substrate made up of a ferrite plate in disk shape and a dielectric ring surrounding the ferrite. A leading end of each of the three main conductor portions is connected to an input/output terminal or a terminal resistor, whereby a signal is input/output or terminated. The three branched conductor portions are designed to have such a shape and a size as to obtain intended high-frequency characteristics (e.g., capacitance).

In the non-reciprocal circuit device described in Japanese Patent Application Laid-Open No. 1997-121104, the leading ends of the respective main conductor portions are expanded in a peripheral direction, and the expanded portions cover the dielectric ring. In Japanese Patent Application Laid-Open No. 1997-121104, a width of each of the expanded portions in the radial direction is substantially equal to a width of the dielectric ring in the radial direction. Thus, if a displacement occurs in amounting position of the center conductor, a change in the high-frequency characteristics becomes very large.

That is, if a displacement occurs in the mounting position of the center conductor, a difference in condition occurs among the three main conductor portions. That is, the expanded portion of a given main conductor portion is overlapped on the disk-shaped ferrite plate, while the expanded portion of another main conductor is not overlapped with the disk-shaped ferrite plate, with the result that the high-frequency characteristics may change significantly.

SUMMARY

An object of the present invention is therefore to provide a non-reciprocal circuit device capable of suppressing a change in the high-frequency characteristics even if a displacement occurs in the mounting position of the center conductor and a communication apparatus using the non-reciprocal circuit device.

A non-reciprocal circuit device according to the present invention includes a substrate including a magnetic plate having a circular surface and a dielectric ring having an annular surface, the circular surface and the annular surface being substantially coplanar; a center conductor disposed on the substrates; and a permanent magnet that applies a magnetic field to the center conductor. The center conductor includes: a main conductor portion positioned on a straight line extending from a center of the circular surface to an outer periphery of the annular surface; and a branched conductor portion integrally formed with the main conductor portion and extending in a radial direction of the substrate from the center of the circular surface. The branched conductor portion includes: a wide portion disposed on the circular surface; and a narrow portion having a width smaller than that of the wide portion and disposed across a boundary between the circular surface and the annular surface.

A communication apparatus according to the present invention includes the above non-reciprocal circuit device.

According to the present invention, the narrow portion is disposed across the boundary between the circular surface and the annular surface, so that even if a displacement occurs in a mounting position of the center conductor, a change in an area of the magnetic plate that is covered by the center conductor and a change in an area of the dielectric ring that is covered by the center conductor are small. Thus, it is possible to suppress a change in high-frequency characteristics due to the displacement of the mounting position of the center conductor.

In the present invention, it is preferable that the narrow portion protrudes in a radial direction from a radial edge of the wide portion. With this configuration, even if a displacement in the radial direction occurs in a mounting portion of the branched conductor portion, it is possible to minimize the influence of the displacement.

In this case, it is preferable that the branched conductor portion further includes a connection portion connected to the narrow portion, the connection portion being disposed on the annular surface. With this configuration, a desired capacitance can be obtained by the connection portion and, even if the mounting position of the branched conductor portion is displaced in the radial direction, it is possible to prevent the connection portion from being overlapped on the magnetic plate and to position the same on the dielectric ring properly.

In this case, the connection portion may have a wider width in a peripheral direction than the wide portion. With this configuration, it is possible to obtain a larger capacitance by the connection portion.

In the present invention, it is preferable that the radial edge of the wide portion has first and second end portions in a peripheral direction of the substrate, and that the narrow portion includes first and second portions that protrude in the radial direction from the first and second end portions of the wide portion, respectively. With this configuration, it is possible to obtain characteristics substantially same as those obtained when the wide portion is disposed across the boundary while suppressing a change in the high-frequency characteristics due to the displacement in the mounting position.

In the present invention, it is preferable that the main conductor portion includes first, second, and third main conductor portions extending radially from the center of the circular surface at an angular interval of about 120°, the wide portion includes first, second, and third wide portions extending radially from the center of the circular surface at an angular interval of about 120° so that the first, second, and third wide portions form an angle of about 60° with the first, second, and third main conductor portions, respectively, and that the first and second portions of the narrow portion protrude in the radial direction from the respective first and second end portions of each of the first, second, and third wide portions. With this configuration, there can be provided a non-reciprocal circuit device having three input/output terminals.

According to the present invention, there can be provided a non-reciprocal circuit device capable of suppressing a change in the high-frequency characteristics even if a displacement occurs in the mounting position of the center conductor and a communication apparatus using the non-reciprocal circuit device.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Figure 1:
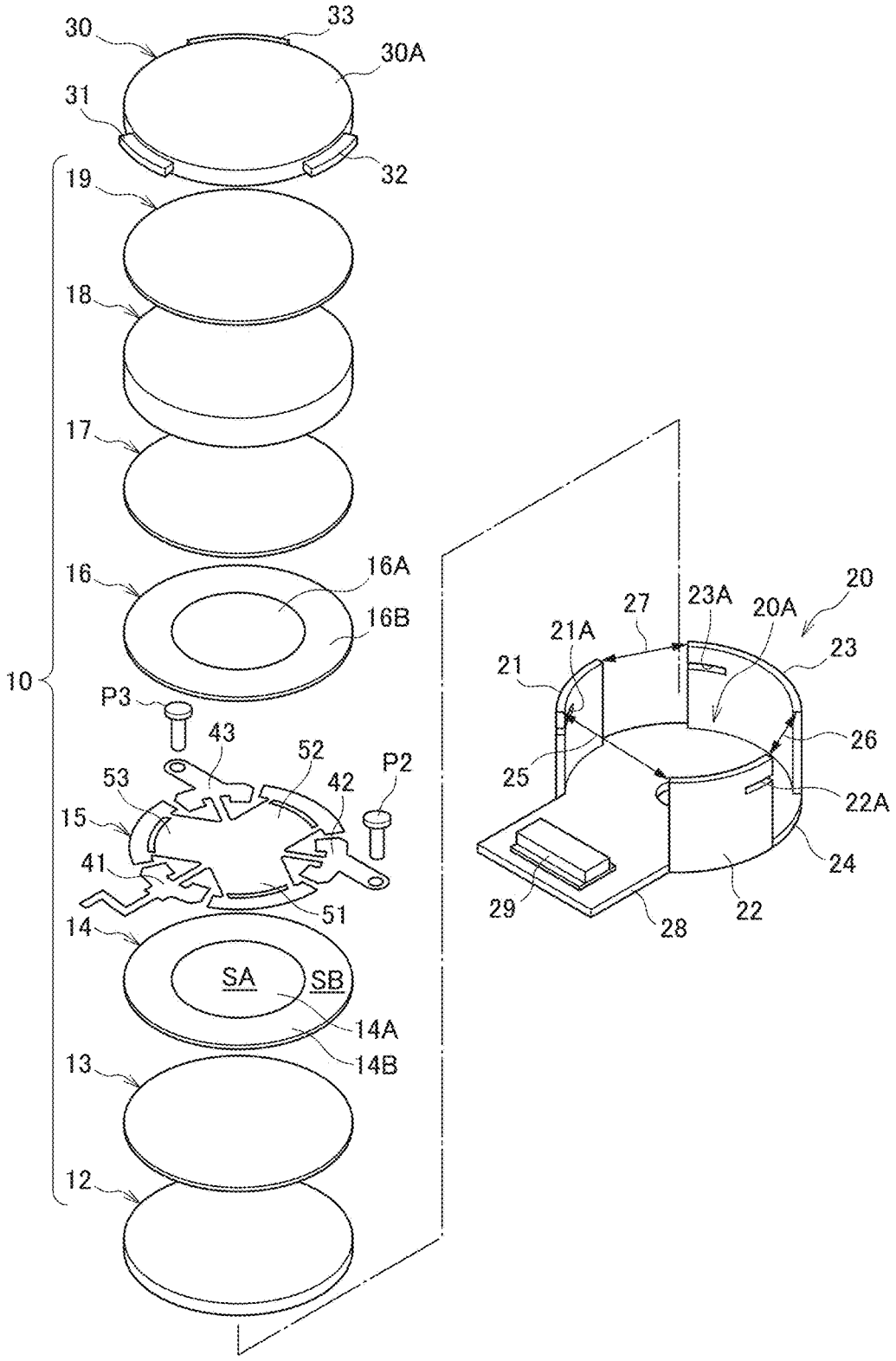
FIG. 1 is an exploded perspective view illustrating a configuration of a non-reciprocal circuit device according to a preferred embodiment of the present invention.

FIG. 1 is an exploded perspective view illustrating a configuration of a non-reciprocal circuit device according to a preferred embodiment of the present invention.

The non-reciprocal circuit device illustrated in FIG. 1 is a distributed constant type isolator and is incorporated in a mobile communication apparatus like a mobile phone or a communication apparatus used in a base station. Although not especially limited, the non-reciprocal circuit device according to the present embodiment is suitable for use in a high-output communication apparatus used in a base station. However, the non-reciprocal circuit device of the present embodiment is not necessarily used as the isolator, but may be used as a circulator and the like.

As illustrated in FIG. 1, the non-reciprocal circuit device of the present embodiment includes a magnetic rotor assembly 10, a case part 20 housing the magnetic rotor assembly 10, and a lid part 30 for closing the case part 20.

The magnetic rotor assembly 10 has a configuration in which a first permanent magnet 12, a shield plate 13, a first substrate 14, a center conductor 15, a second substrate 16, a first non-magnetic sheet 17, a second permanent magnet 18, and a second non-magnetic sheet 19 which are stacked in the mentioned order and integrated with one another by a not illustrated conductive bonding agent.

Each of the first and second permanent magnets 12 has a disk shaped body having a plate surface diameter of several tens of mm and each have a role of applying a magnetic field to a magnetic rotor constituted by the first substrate 14, the center conductor 15, and the second substrate 16. The second permanent magnet 18 is sandwiched between the first and second non-magnetic sheets 17 and 19.

The shield plate 13 is a disk shaped conductor plate punched from a copper plate or an iron plate having a plate surface diameter of several tens of mm and a thickness of about 0.1 mm to 0.2 mm and is used for strengthening and stabilizing a ground electrode.

The first substrate 14 is constituted by a disk-shaped magnetic plate 14A and a dielectric ring 14B fitted around the disk-shaped magnetic plate 14A. As a material for the disk-shaped magnetic plate 14A, a soft magnetic member such as yttrium/iron/garnet (YIG) is preferably used. As a material for the dielectric ring 14B, a ceramic having a desired dielectric constant is preferably used. A circular surface SA which is a main surface of the disk-shaped magnetic plate 14A and an annular surface SB which is a main surface of the dielectric ring 14B constitute the same plane. Thus, the disk-shaped magnetic plate 14A and the dielectric ring 14B have substantially the same thickness (e.g., about 1.0 mm). A diameter of the first substrate 14 is several tens of mm.

Like the above first substrate 14, the second substrate 16 is constituted by a disk-shaped magnetic plate 16A and a dielectric ring 16B fitted around the disk-shaped magnetic plate 16A.

The center conductor 15 is a conductor plate obtained by processing a copper plate having a thickness of about 0.1 mm to 1.0 mm and includes first to third main conductor portions 41 to 43 and first to third branched conductor portions 51 to 53. The first to third main conductor portions 41 to 43 are conductor portions connected respectively to their corresponding terminals and extend radially from a center of the center conductor 15 at an angular interval of 120°. In the present embodiment, a leading end of the first main conductor portion 41 is connected to a terminal resistor 29, a leading end of the second main conductor portion 42 is connected to a pin terminal P2, and a leading end of the third main conductor portion 43 is connected to a pin terminal P3. Each of the pin terminals P2 and P3 is used as an input/output terminal of the isolator. When the non-reciprocal circuit device according to the present embodiment is used as a circulator, the first main conductor portion 41 is connected not to the terminal resistor 29, but to another pin terminal.

The first to third branched conductor portions 51 to 53 are integrally formed with the main conductor portions 41 to 43 and extend radially from a center of the circular surface SA at an angular interval of 120°. Among the six conductor portions 41 to 43 and 51 to 53, two conductor portions disposed adjacent to each other in a peripheral direction form an angle of 60°. A shape of the center conductor 15 and a positional relationship between the center conductor 15 and first substrate 14 will be described later.

The magnetic rotor assembly 10 is housed in the case part 20. The case part 20 is formed into a substantially cylindrical body or a substantially container-like body and has, therein, a housing portion 20A which is a space for housing the magnetic rotor assembly 10. An internal shape of the case part 20 is substantially cylindrical as a whole. The case part 20 is preferably formed of a magnetic metal material such as iron to thereby function as a yoke for the magnetic rotor assembly 10 housed in the housing portion 20A.

The housing portion 20A of the case part 20 is defined by three side walls 21 to 23 and a bottom portion 24 constituting a bottom surface portion. The side walls 21 to 23 stand on the same circumference from a periphery of the bottom portion 24 at a predetermined interval from one another and each have, at one of both standing end surfaces, a concave portion (concave portions 21A to 23A) cut along the peripheral direction.

Opening portions 25 to 27 are formed at portions at which adjacent end edges of the side walls 21 to 23 face each other. The leading ends of the first to third main conductor portions 41 to 43 are led outside from the opening portions 25 to 27.

The lid part 30, in which a lid plate portion 30A constituting a main part thereof has a disk shape as a whole, is used as a lid for closing the housing portion 20A when being combined with the case part 20. That is, a shape of the lid part 30 is determined depending on an internal shape of the case part 20 in terms of its intended use. In the present embodiment, the case part 20 has a substantially cylindrical shape and, accordingly, the lid part 30 is formed into a disk shape. The lid part 30 is preferably formed of a magnetic metal material such as iron to thereby function as a yoke for the magnetic rotor assembly 10 together with the case part 20.

The lid plate portion 30A of the lid part 30 has a diameter and a contour shape that can be fitted to an opened end surface of the case part 20. In other words, the lid plate portion 30A has a shape having a diameter slightly smaller than an internal diameter of the opened end surface of the case part 20. With this configuration, when the lid plate portion 30A is fitted to the opened end surface of the case part 20, a height of the non-reciprocal circuit device can be reduced by a thickness of the lid plate portion 30A. Preferably, an upper surface of the lid plate portion 30A and an upper end surface constitute substantially the same plane.

The lid plate portion 30A has a circular outer shape and has convex portions 31 to 33 at its circular outer peripheral surface. The convex portions 31 to 33 are fitted into the concave portions 21A to 23A of the case part 20, respectively. Thus, the convex portions 31 to 33 have a width (thickness) corresponding to that of the concave portions 21A to 23A and are formed at intervals corresponding to intervals at which the concave portions 21A to 23A are formed. The convex portions 31 to 33 each have a simple shape obtained by making the outer peripheral surface of the lid plate portion 30A radially protrude.

Leading ends of the convex portions 31 to 33 are inserted into the concave portions 21A to 23A, respectively, and then, the lid part 30 or the case part 20 is rotated relatively. As a result, the case part 20 and the lid part 30 can be fitted to each other in a convex and concave way.

The bottom portion 24 constituting the case part 20 has a protruding portion 28 radially protruding through the opening portion 25. The protruding portion 28 is provided with the terminal resistor 29 for absorbing reflective waves. With this configuration, the non-reciprocal circuit device according to the present embodiment can be used as an isolator.

Figure 2:
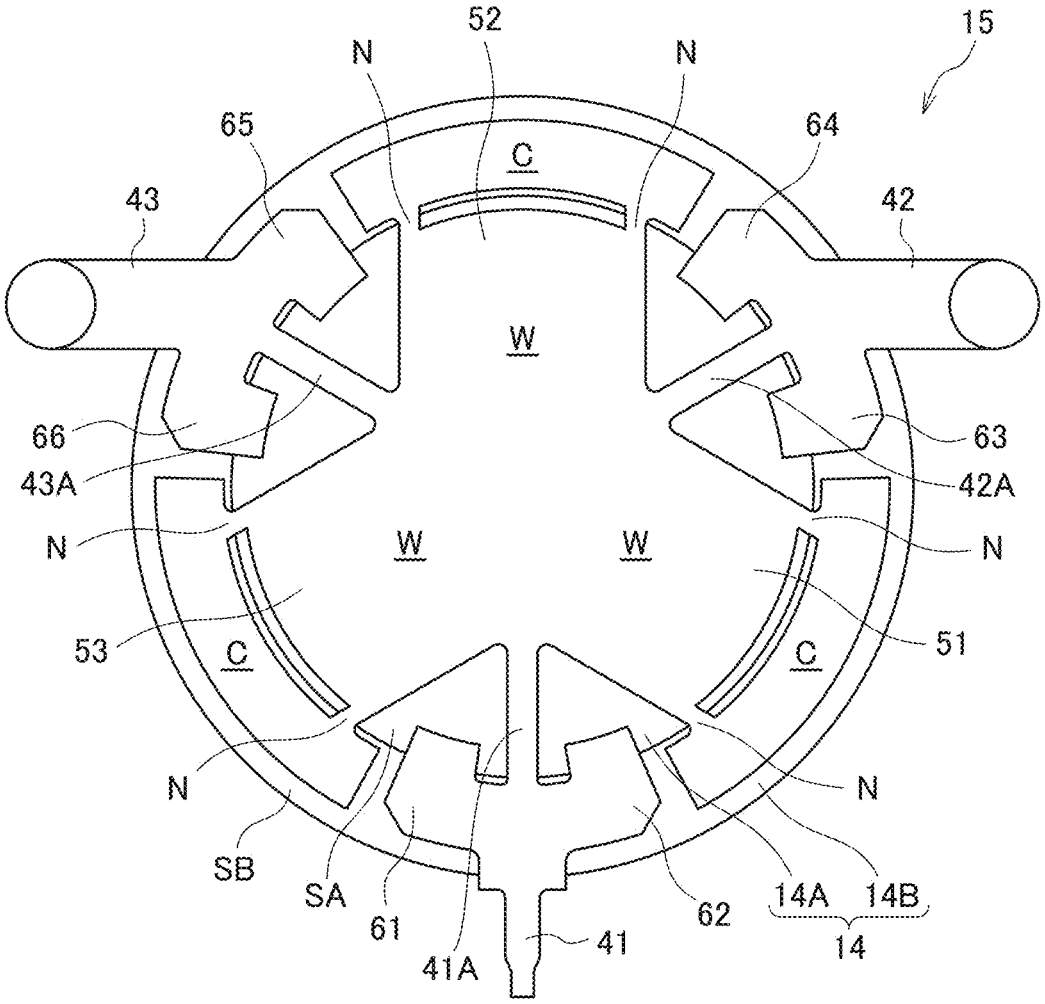
FIG. 2 is a plan view for explaining a shape of the center conductor and a positional relationship between the center conductor and the first substrate in a first embodiment.

FIG. 2 is a plan view for explaining a shape of the center conductor 15 and a positional relationship between the center conductor 15 and the first substrate 14 in a first embodiment.

As illustrated in FIG. 2, the center conductor 15 has the first to third main conductor portions 41 to 43 and the first to third branched conductor portions 51 to 53, all of which are positioned on the circular surface SA of the magnetic plate 14A or annular surface SB of the dielectric ring 14B.

The first main conductor portion 41 has a linear portion 41A linearly extending from a center of the circular surface SA to an outer periphery of the annular surface SB, and has two protruding portions 61 and 62 branched from the linear portion 41A and extending in the peripheral direction. The second main conductor portion 42 has a linear portion 42A linearly extending from the center of the circular surface SA to the outer periphery of the annular surface SB, and has two protruding portions 63 and 64 branched from the linear portion 42A and extending in the peripheral direction. The third main conductor portion 43 has a linear portion 43A linearly extending from the center of the circular surface SA to the outer periphery of the annular surface SB, and has two protruding portions 65 and 66 branched from the linear portion 43A and extending in the peripheral direction.

The linear portions 41A to 43A each extend in the radial direction over the circular surface SA and the annular surface SB, while the protruding portions 61 to 66 are each branched in the peripheral direction on the annular surface SB and then bent so as to extend in the radial direction. The part of each of the protruding portions 61 to 66 that extends in the radial direction is disposed across a boundary between the annular surface SB of the dielectric ring 14B and the circular surface SA of the magnetic plate 14A.

The first branched conductor portion 51 is positioned between the linear portions 41A and 42A and radially extends from the center of the circular surface SA. The second branched conductor portion 52 is positioned between the linear portions 42A and 43A and radially extends from the center of the circular surface SA. The third branched conductor portion 53 is positioned between the linear portions 43A and 41A and radially extends from the center of the circular surface SA.

In the present embodiment, each of the branched conductor portions 51 to 53 is constituted by a wide portion W, a narrow portion N, and a connection portion C. As illustrated in FIG. 2, the wide portion W is a portion having a wide width in the peripheral direction and is positioned on the circular surface SA of the magnetic plate 14A. The narrow portion N is a portion having a narrow width in the peripheral direction and protrudes in the radial direction from the wide portion W across the boundary between the circular surface SA and the annular surface SB. The connection portion C is a portion having a wide width in the peripheral direction, positioned on the annular surface SB of the dielectric ring 14B, and connected to the wide portion W through the narrow portion N.

Specifically, an edge of the wide portion W in the radial direction is disposed at a position slightly offset to the circular surface SA side from the boundary between the circular surface SA and the annular surface SB. An inner peripheral edge of the connection portion C in the radial direction is disposed at a position slightly offset to the annular surface SB side from the boundary between the circular surface SA and the annular surface SB. Accordingly, the boundary between the circular surface SA and the annular surface SB is positioned between the edge the wide portion W and the edge of the connection portion C. Through the narrow portion N disposed across the boundary, the wide portion W and the connection portion C are connected to each other. Although not especially limited in the present embodiment, the width of the connection portion C in the peripheral direction is larger than the width of the wide portion W in the peripheral direction, thereby ensuring a large capacitance.

In the first embodiment illustrated in FIG. 2, two narrow portions N are provided for each of the branched conductor portions 51 to 53 and disposed at both ends of the edge of the wide portion W in the peripheral direction. Thus, the branched conductor portions 51 to 53 each are hollowed in an island shape at a portion on the boundary between the circular surface SA and the annular surface SB.

As described above, in the present embodiment, the narrow portion N having a narrow width is disposed across the boundary between the circular surface SA and the annular surface SB, so that even if a displacement occurs when the center conductor 15 is overlapped on the first substrate 14, a change in an area of the magnetic plate 14A (and magnetic plate 16A) that is covered by the center conductor 15 or a change in an area of the dielectric ring 14B (and dielectric ring 16B) that is covered by the center conductor 15 is small. Thus, it is possible to suppress a change in the high-frequency characteristics due to the displacement. In other words, a length of the narrow portion N serves as a margin for the displacement. Thus, by determining the length of the narrow portion N in consideration of the displacement that can occur during assembly, it is possible to reliably suppress a change in the high-frequency characteristics due to the displacement.

Figure 3:
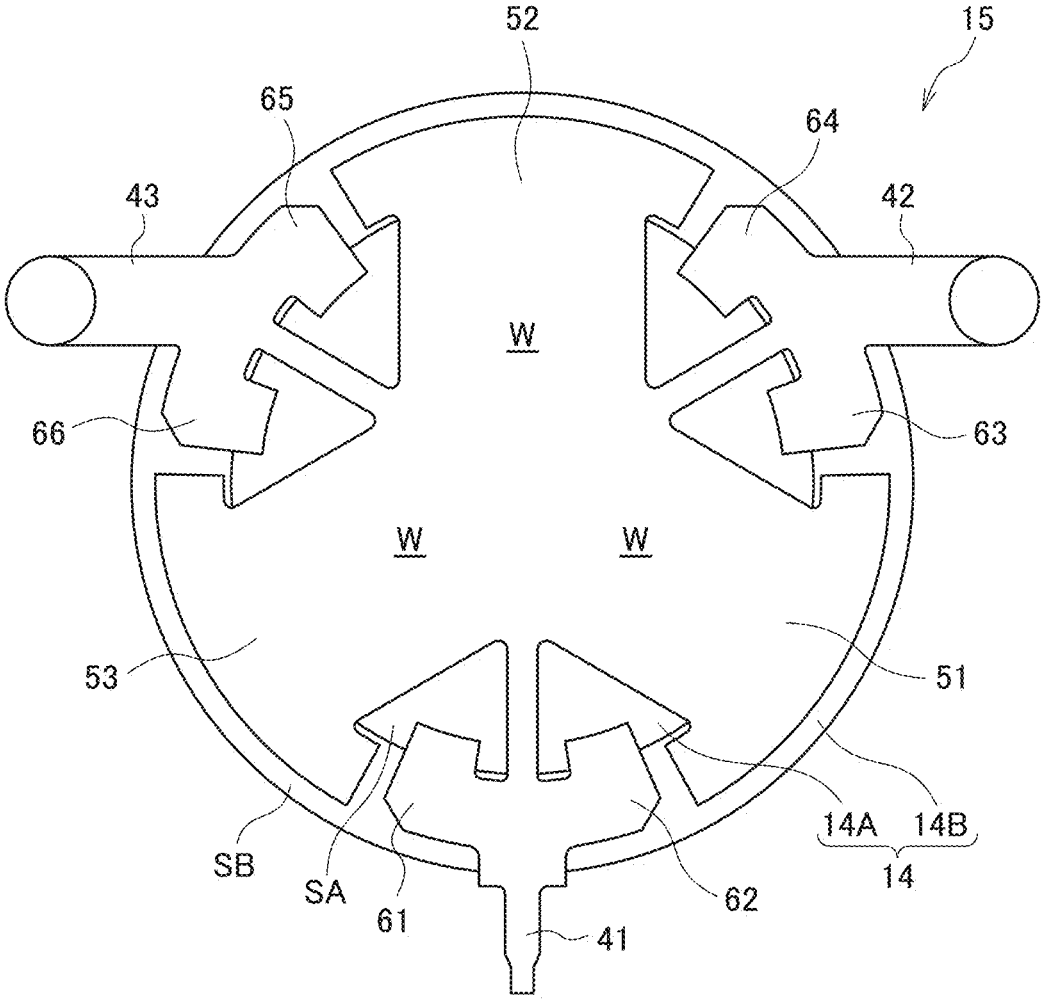
FIG. 3 is a plan view for explaining a shape of the center conductor and a positional relationship between the center conductor and the first substrate in a first comparative example.

In addition, each of the branched conductor portions 51 to 53 is hollowed in an island shape at a portion on the boundary between the circular surface SA and the annular surface SB, and the width of the wide portion W and a width of a portion connecting the two narrow portions N are substantially equal to each other. Thus, in terms of the high-frequency characteristics, it is possible to obtain substantially the same characteristics as those obtained in a case where a center conductor having a shape of a reference example of FIG. 3 is used. This is because that inductance at a high frequency region depends largely on the conductor width and that the center hollow portion has a small influence on the inductance.

In the case of the shape of the reference example of FIG. 3, if a displacement occurs in the center conductor 15, a change in the area of the magnetic plate 14A (and magnetic plate 16A) that is covered by the center conductor 15 and a change in an area of the dielectric ring 14B (and dielectric ring 16B) that is covered by the center conductor 15 become significantly large, resulting in a large change in the high-frequency characteristics. On the other hand, as described above, in the shape according to the first embodiment illustrated in FIG. 2, a change in the high-frequency characteristics can be suppressed even if a displacement occurs.

Figure 4A:
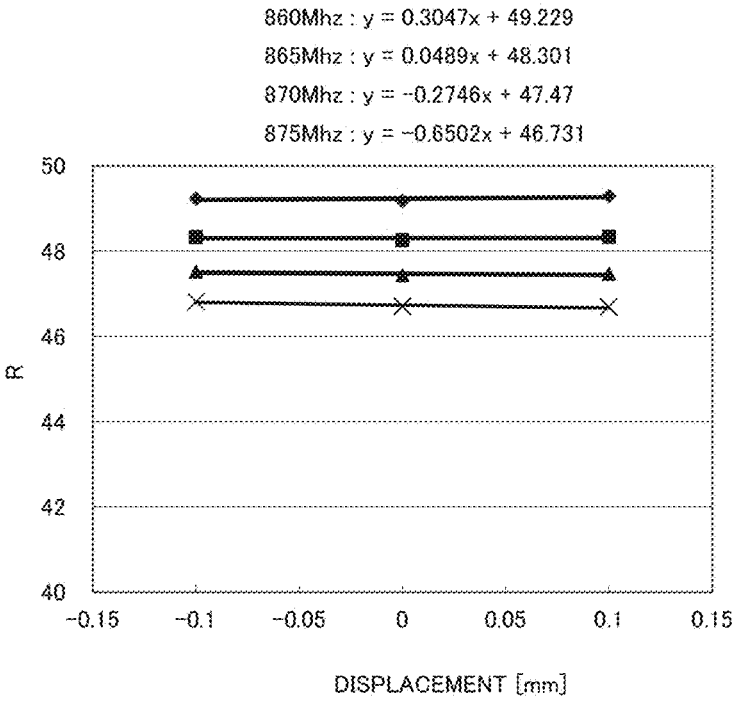
FIGS. 4A and 4B are graphs illustrating an input return loss of an isolator when the center conductor according to the first embodiment illustrated in FIG. 2 is used.
Figure 4B:
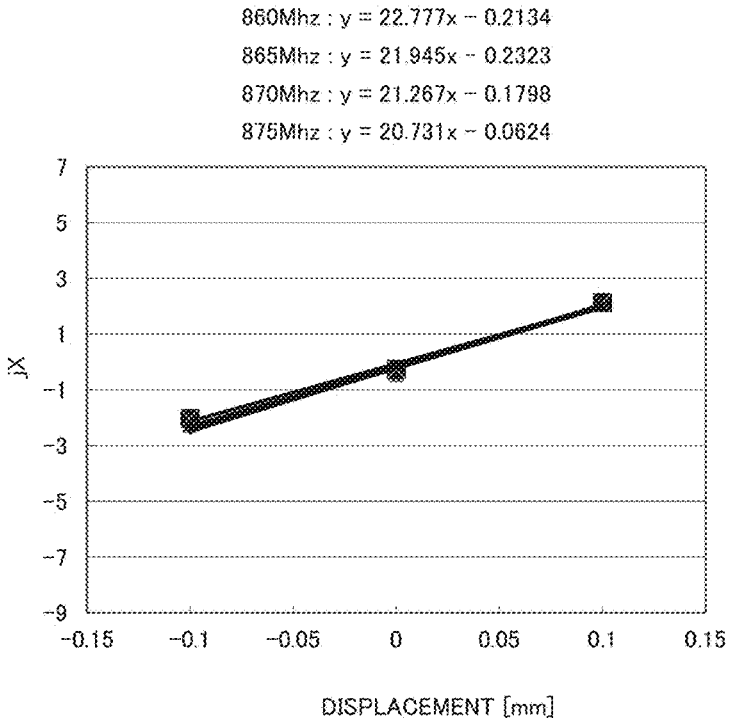
Figure 5A:
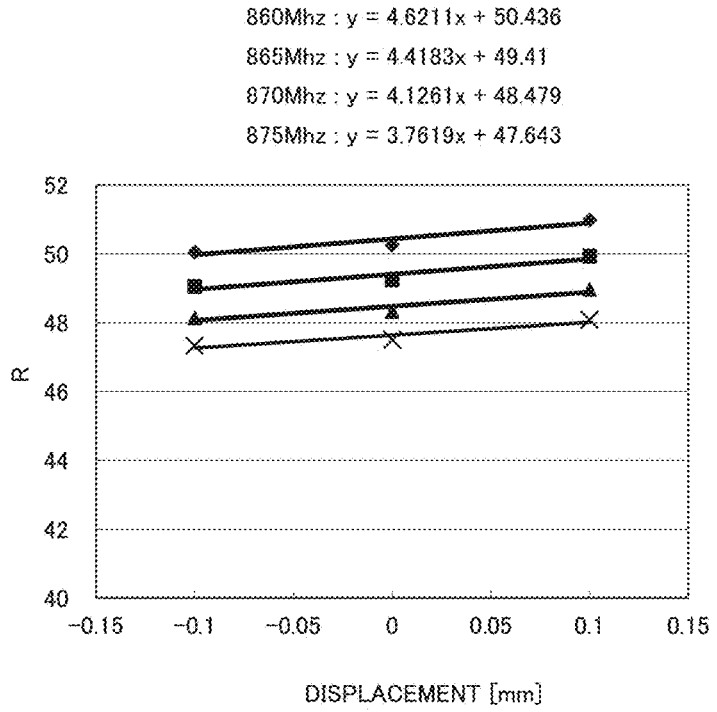
FIGS. 5A and 5B are graphs illustrating an input return loss of an isolator when the center conductor according to the first comparative example illustrated in FIG. 3 is used.
Figure 5B:
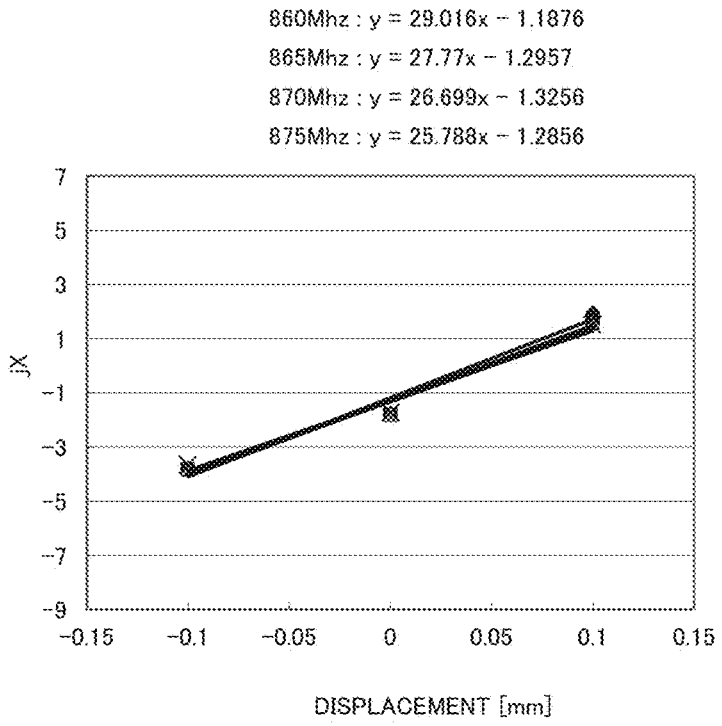
Figure 6:
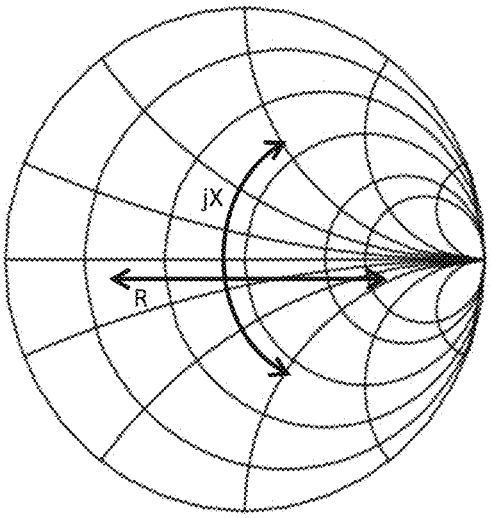
FIG. 6 is a Smith chart for explaining an R value and a jX value.

FIGS. 4A and 4B are graphs illustrating an input return loss of an isolator when the center conductor 15 according to the first embodiment illustrated in FIG. 2 is used, and FIGS. 5A and 5B are graphs illustrating an input return loss of an isolator when the center conductor 15 according to the first comparative example illustrated in FIG. 3 is used. FIG. 4A and FIG. 5A each illustrate a relationship between an R value and a displacement amount on the Smith chart shown in FIG. 6, and FIG. 4B and FIG. 5B each illustrate a relationship between a jX value and a displacement amount on the Smith chart shown in FIG. 6.

Values shown in FIGS. 4A, 4B, 5A, and 5B are input return losses when input signal frequencies are set to 860 MHz, 865 MHz, 870 MHz, and 875 MHz and are plotted by ◆, ■, ▲, and x marks, respectively. Further, an approximate straight line is obtained based on each plot and represented as an equation with horizontal and vertical axes being as x and y. Thus, a square of x in the equation represents an inclination of the approximate straight line.

It can be seen from a comparison between FIGS. 4A and 4B and FIGS. 5A and 5B that the inclination of the graphs of FIGS. 4A and 4B are smaller than the inclination of the graphs of FIGS. 5A and 5B. That is, a change in the R value and jX value with respect to the displacement is smaller in a case where the center conductor 15 according to the first embodiment illustrated in FIG. 2 is used than in a case where the center conductor 15 according to the first comparative example illustrated in FIG. 3 is used. In particular, the inclination of the R value illustrated in FIG. 4A is remarkably improved, thereby effectively suppressing a change in the characteristics due to the displacement.

Figure 7:
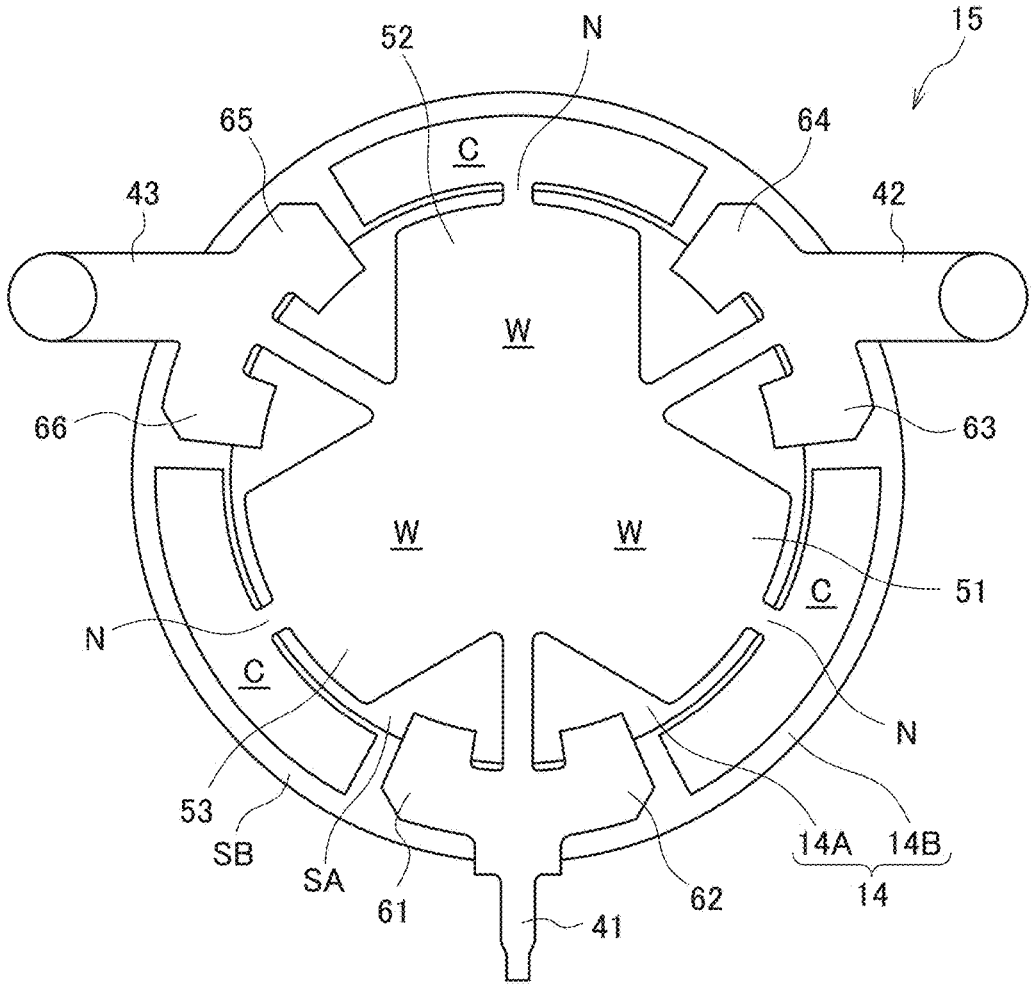
FIG. 7 is a plan view for explaining a shape of the center conductor and a positional relationship between the center conductor and the first substrate in a second embodiment.

FIG. 7 is a plan view for explaining a shape of the center conductor 15 and a positional relationship between the center conductor 15 and the first substrate 14 in a second embodiment.

The center conductor 15 according to the second embodiment differs from the center conductor 15 illustrated in FIG. 2 in that one narrow portion N is provided for each of the branched conductor portions 51 to 53 and is disposed at a center portion of the edge of the wide portion W in the peripheral direction. Other points are the same as those of the center conductor 15 illustrated in FIG. 2, so the same reference numerals are given to the same parts, and the repeated description will be omitted.

Even in such a configuration, it is possible to suppress a change in the high-frequency characteristics due to the displacement, as in the first embodiment. In addition, only one narrow portion N that is disposed across the circular surface SA and the annular surface SB is provided for each of the branched conductor portions 51 to 53, so that even if a displacement occurs in the center conductor 15, a change in the area of the magnetic plate 14A (and magnetic plate 16A) that is covered by the center conductor 15 and a change in the area of the dielectric ring 14B (and dielectric ring 16B) that is covered by the center conductor 15 are smaller than those in the first embodiment.

However, in the present embodiment, both ends of the radial edge of the wide portion W in the peripheral direction are opened, so that, as illustrated in Table 1 below, the high-frequency characteristics significantly differ from those in a case where the center conductor having the shape illustrated in FIG. 2 is used. Specifically, values of an insertion loss, an input return loss, an output return loss, and an isolation obtained when the center conductor 15 having the shape of FIG. 2 are more satisfactory than those obtained when the center conductor 15 having the shape of FIG. 7. The reason for this is that, as described above, inductance at a high frequency region depends largely on the conductor width, so that, in the structure of FIG. 7, the inductance changes significantly at the narrow portion N. The value of the insertion loss becomes improved as it approaches to 0, and the values of the input return loss, the output return loss, and the isolation become improved as they become smaller.

TABLE 1

| | First embodiment (FIG. 2) | Second embodiment (FIG. 7) |
|---|---|---|
| Insertion loss | −0.047 dB | −0.23 dB |
| Input return loss | −33.0 dB | −16.8 dB |
| Output return loss | −33.9 dB | −16.5 dB |
| Isolation | −26.1 dB | −15.6 dB |

Figure 8:
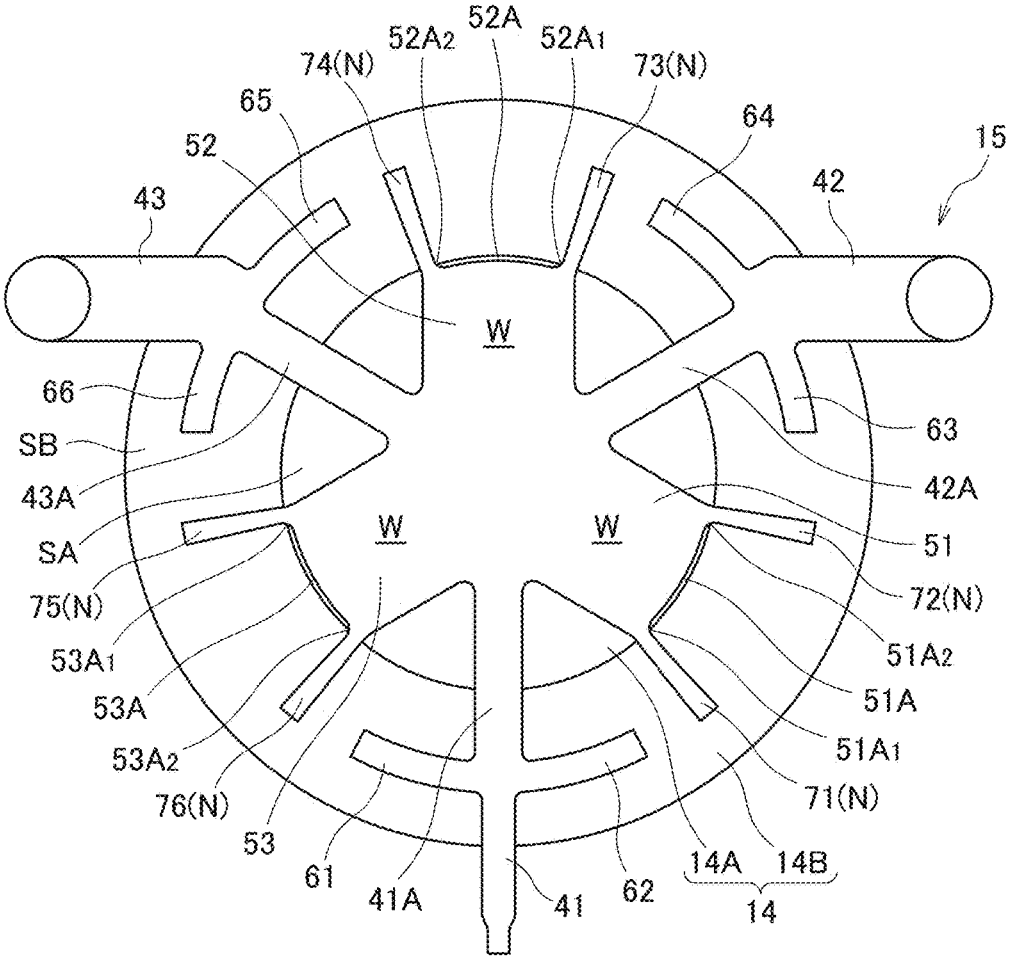
FIG. 8 is a plan view for explaining a shape of the center conductor and a positional relationship between the center conductor and the first substrate in a third embodiment.

FIG. 8 is a plan view for explaining a shape of the center conductor 15 and a positional relationship between the center conductor 15 and the first substrate 14 in a third embodiment.

As illustrated in FIG. 8, the center conductor 15 has the first to third main conductor portions 41 to 43 and the first to third branched conductor portions 51 to 53, all of which are positioned on the circular surface SA of the magnetic plate 14A or annular surface SB of the dielectric ring 14B.

The first main conductor portion 41 has a linear portion 41A linearly extending from a center of the circular surface SA to an outer periphery of the annular surface SB, and has two protruding portions 61 and 62 branched from the linear portion 41A and extending in the peripheral direction. The second main conductor portion 42 has a linear portion 42A linearly extending from the center of the circular surface SA to the outer periphery of the annular surface SB, and has two protruding portions 63 and 64 branched from the linear portion 42A and extending in the peripheral direction. The third main conductor portion 43 has a linear portion 43A linearly extending from the center of the circular surface SA to the outer periphery of the annular surface SB, and has two protruding portions 65 and 66 branched from the linear portion 43A and extending in the peripheral direction.

The linear portions 41A to 43A each extend radially over the circular surface SA and the annular surface SB, while the protruding portions 61 to 66 each extend in the peripheral direction on the annular surface SB. A width (width in the radial direction) of each of the protruding portions 61 to 66 is smaller than a width (width in the peripheral direction) of each of the linear portions 41A to 43A.

As described above, the protruding portions 61 to 66 branched from the main conductor portions 41 to 43 each extend in an elongated shape in the peripheral direction on the annular surface SB of the dielectric ring 14B and can thus cover the dielectric ring 14B over a wider range while reducing an area of the dielectric ring 14B that is covered by the center conductor 15.

The first branched conductor portion 51 is positioned between the linear portions 41A and 42A and radially extends from the center of the circular surface SA. The second branched conductor portion 52 is positioned between the linear portions 42A and 43A and radially extends from the center of the circular surface SA. The third branched conductor portion 53 is positioned between the linear portions 43A and 41A and radially extends from the center of the circular surface SA.

A width (width in the peripheral direction) of the wide portion W of each of the branched conductor portions 51 to 53 is larger than a width of each of the linear portions 41A to 43A. The wide portion W of each of the branched conductor portions 51 to 53 is positioned on the circular surface SA of the magnetic plate 14A, but the narrow portions N that are protruding portions 71 to 76 that protrude from the wide portions W is positioned on the annular surface SB of the dielectric ring 14B.

Specifically, edges 51A to 53A of the wide portions W of the branched conductor portions 51 to 53 in the radial direction are disposed at positions slightly offset to the circular surface SA side from a boundary between the circular surface SA and the annular surface SB. The edge 51A has a first end portion 51$A_1$ and a second end portion 51$A_2$ in the peripheral direction, from which two protruding portions 71 and 72 that constitute the narrow portion N radially protrude, respectively. The edge 52A has a first end portion 52$A_1$ and a second end portion 52$A_2$ in the peripheral direction, from which two protruding portions 73 and 74 that constitute the narrow portion N radially protrude, respectively. The edge 53A has a first end portion 53$A_1$ and a second end portion 53$A_2$ in the peripheral direction, from which two protruding portions 75 and 76 that constitute the narrow portion N radially protrude, respectively.

The protruding portions 71 to 76 that constitute the narrow portion N each extend across the boundary between the circular surface SA and the annular surface SB and each mostly positioned on the annular surface SB of the dielectric ring 14B. A width (width in the peripheral direction) of each of the protruding portions 71 to 76 is smaller than the width (width in the peripheral direction) of each of the linear portions 41A to 43A.

As described above, the protruding portions 71 to 76 protruding from the branched conductor portions 51 to 53 each extend in an elongated shape in the radial direction on the annular surface SB of the dielectric ring 14B and can thus cover the dielectric ring 14B over a wider range while reducing the area of the dielectric ring 14B that is covered by the center conductor 15.

As described above, in the present embodiment, the elongated protruding portions 61 to 66 extending in the peripheral direction and the elongated protruding portions 71 to 76 extending in the radial direction are disposed on the annular surface SB of the dielectric ring 14B. This makes it possible to cover the dielectric ring 14B over a wide range by the center conductor 15 while reducing the area of the dielectric ring 14B that is covered by the center conductor 15.

Thus, a stress to be applied to the dielectric ring 14B (and dielectric ring 16B) when the first and second substrates 14 and 16 are overlapped with each other through the center conductor 15 is dispersed, making it less likely for a local stress to be applied to a specific portion, which can prevent the substrate from being damaged during assembly. In addition, the protruding portions 61 to 66 and 71 to 76 each have an elongated shape, so that the area of the dielectric ring 14B (and dielectric ring 16B) that is covered by the center conductor 15 can be sufficiently reduced. As a result, it is possible to reduce influence that the protruding portions 61 to 66 and 71 to 76 have on the high-frequency characteristics, thereby allowing intended high-frequency characteristics to be obtained properly.

Further, in the present embodiment, the elongated protruding portions 71 to 76 extends across the boundary between the circular surface SA and the annular surface SB, so that even if a displacement occurs when the center conductor 15 is overlapped on the first substrate 14, a change in an area of the magnetic plate 14A (and magnetic plate 16A) that is covered by the center conductor 15 and a change in the area of the dielectric ring 14B (and dielectric ring 16B) that is covered by the center conductor 15 are small. Thus, it is possible to suppress a change in the high-frequency characteristics due to the displacement.

Figure 9:
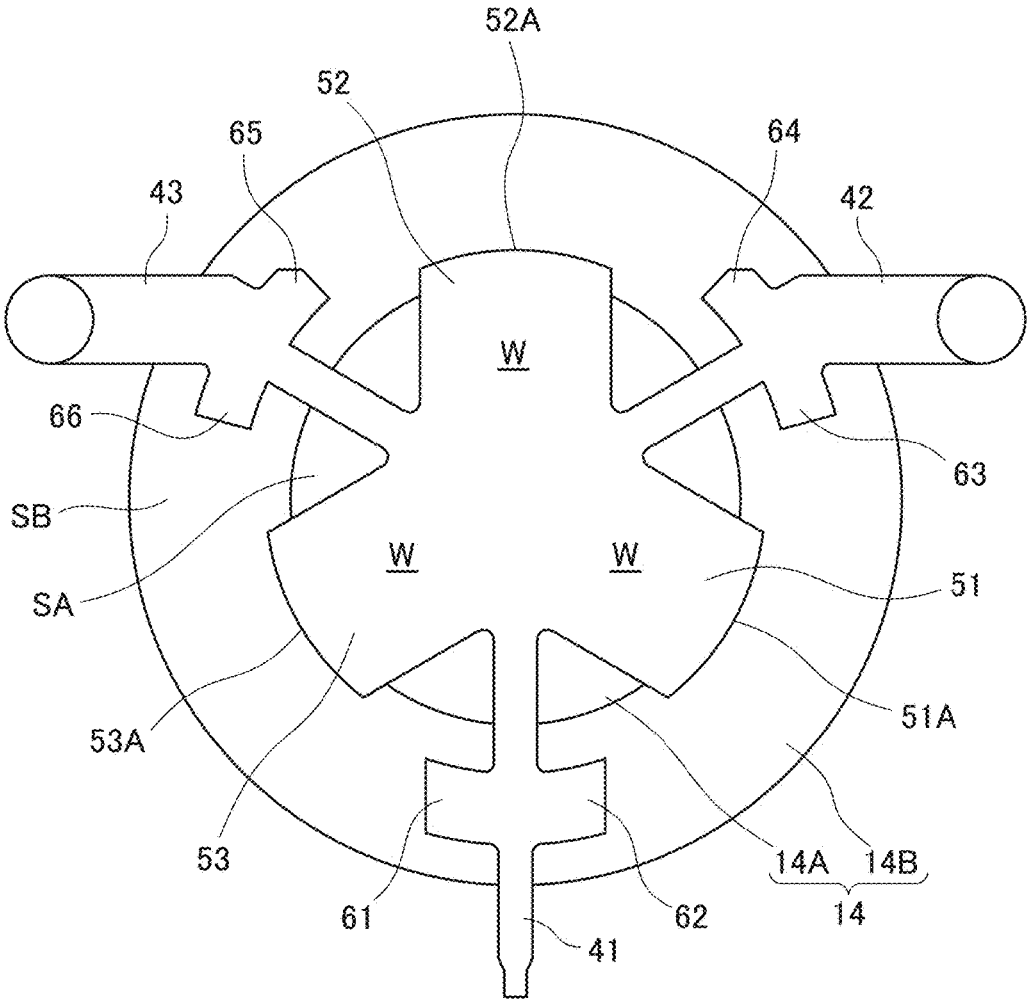
FIG. 9 is a plan view for explaining a shape of the center conductor and a positional relationship between the center conductor and the first substrate in a second comparative example.

FIG. 9 is a plan view for explaining a shape of the center conductor 15 and a positional relationship between the center conductor 15 and the first substrate 14 in the second comparative example.

In the comparative example illustrated in FIG. 9, the width of each of the protruding portions 61 to 66 is larger than that in the third embodiment, and the edges 51A to 53A of the branched conductor portions 51 to 53 extend up to the annular surface SB of the dielectric ring 14B. Further, in the second comparative example, the protruding portions 71 to 76 that constitute the narrow portion N are not provided. That is, the branched conductor portions 51 to 53 are formed only by the wide portions W. Although there are such differences in shape, the area of the magnetic plate 14A that is covered by the center conductor 15 and the area of the dielectric ring 14B that is covered by the center conductor 15 are almost the same as those of the third embodiment illustrated in FIG. 8. Thus, the high-frequency characteristics to be obtained are not changed significantly.

However, in the second comparative example of FIG. 9, the width of each of the protruding portions 61 to 66 is large and, accordingly, a length thereof in the peripheral direction becomes necessarily small. Further, the branched conductor portions 51 to 53 do not have the protruding portions 71 to 76. As a result, the annular surface SB of the dielectric ring 14B is exposed from the center conductor 15 over a wide range, so that a local stress is applied to a specific portion of the dielectric ring 14B when the first substrate 14A and the second substrate 16A are overlapped with each other through the center conductor 15, which may damage the substrates 14A and 16A. In particular, when a strong stress is applied near the edges 51A to 53A of the branched conductor portions 51 to 53, a part of the dielectric ring 14B near an inner periphery thereof which is easy to be damaged is pressed strongly, with the result that substrates 14A and 16A damage may easily occur.

On the other hand, such problems can be solved by the above-described third embodiment, and thus it is possible to effectively prevent the substrate from being damaged during assembly.

Further, in the second comparative example of FIG. 9, the wide portions W of each of the branched conductor portions 51 to 53 extends across the boundary between the circular surface SA and the annular surface SB, so that when a displacement occurs when the center conductor 15 is overlapped on the first substrate 14, the area of the magnetic plate 14A that is covered by the center conductor 15 and the area of the dielectric ring 14B that is covered by the center conductor 15 significantly change.

On the other hand, such a problem can be solved by the above-described third embodiment, and thus it is possible to suppress the change in the high-frequency characteristics due to the displacement.

Figure 10:
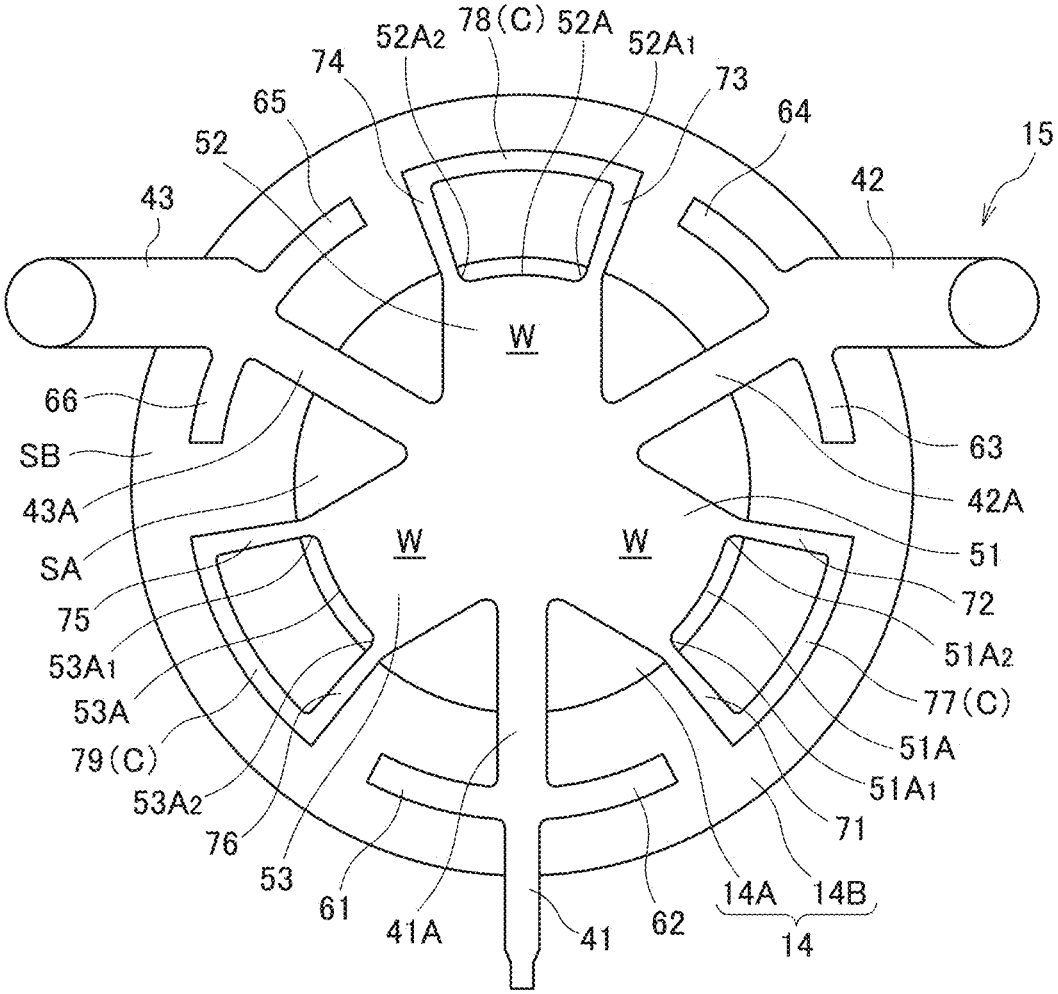
FIG. 10 is a plan view for explaining a shape of the center conductor and a positional relationship between the center conductor and the first substrate in a fourth embodiment.

FIG. 10 is a plan view for explaining a shape of the center conductor 15 and a positional relationship between the center conductor 15 and the first substrate 14 in the fourth embodiment.

The center conductor 15 according to the fourth embodiment differs from the center conductor 15 illustrated in FIG. 8 in that protruding portions 77 to 79 that are connection portions C are added. Other points are the same as those of the center conductor 15 illustrated in FIG. 8, so the same reference numerals are given to the same parts, and the repeated description will be omitted.

The protruding portion 77 that is connection portion C constitutes a part of the first branched conductor portion 51 and extends on the annular surface SB in the peripheral direction so as to connect the protruding portions 71 and 72 that are the narrow portions N. The protruding portion 78 that is connection portion C constitutes a part of the second branched conductor portion 52 and extends on the annular surface SB in the peripheral direction so as to connect the protruding portions 73 and 74 that are the narrow portions N. The protruding portion 79 that is connection portion C constitutes a part of the third branched conductor portion 53 and extends on the annular surface SB in the peripheral direction so as to connect the protruding portions 75 and 76 that are the narrow portions N.

A width of each of the protruding portions 77 to 79 in the radial direction is substantially the same as the width of each of the protruding portions 71 to 76 in the peripheral direction and is, accordingly, smaller than the width of each of the linear portions 41A to 43A in the peripheral direction.

Such a configuration is suitable for use in a case where a larger capacitance than that in the third embodiment illustrated in FIG. 8 is required. According to the fourth embodiment, a larger capacitance than that in the third embodiment can be obtained, and the dielectric ring 14B can be covered by the center conductor 15 over a wider range and with higher density than in the third embodiment, thereby making it possible to prevent more effectively damage of the substrate during assembly.

Figure 11:
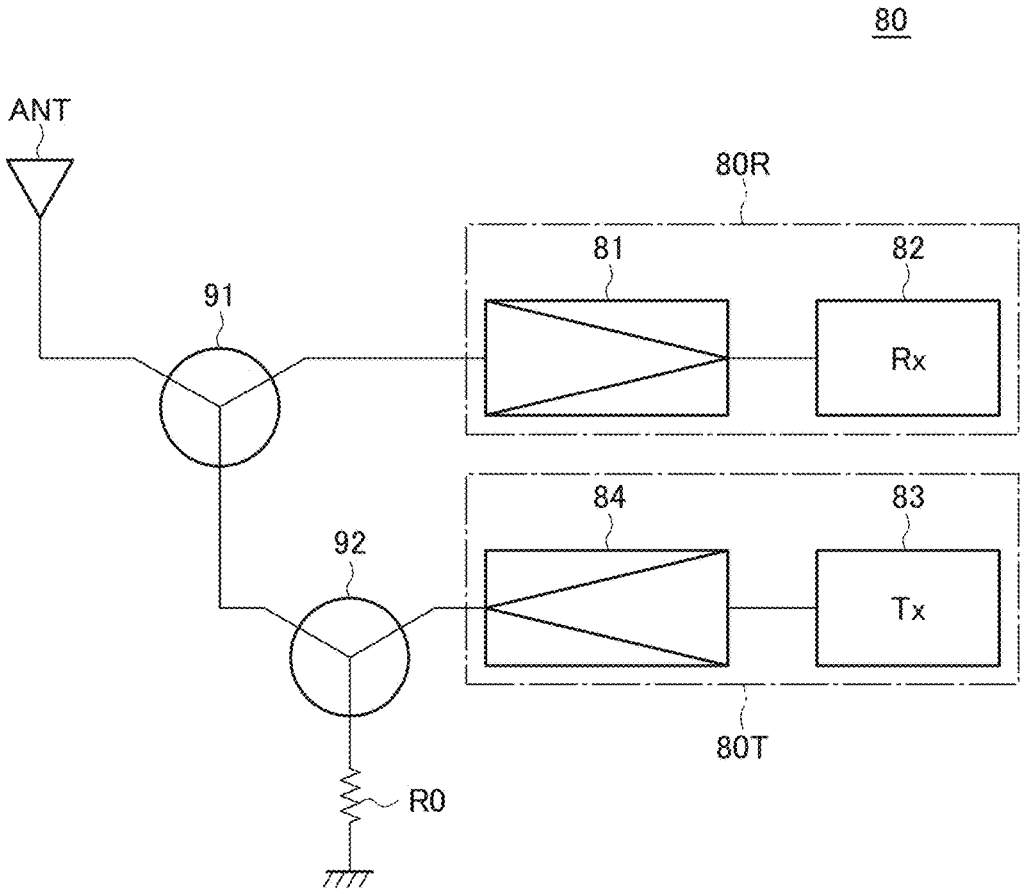
FIG. 11 is a block diagram illustrating a configuration of a communication apparatus using the non-reciprocal circuit device according to the embodiment.

FIG. 11 is a block diagram illustrating a configuration of a communication apparatus 80 using the non-reciprocal circuit device according to the present embodiment.

The communication apparatus 80 illustrated in FIG. 11 is provided in a base station for, e.g., a mobile communication system. The communication apparatus 80 includes a receiver circuit section 80R and a transmission circuit section 80T, which are connected to a transmission/reception antenna ANT. The receiver circuit section 80R includes a receiver amplifier circuit 81 and a receiver circuit 82 that processes a received signal. The transmission circuit section 80T includes a transmission circuit 83 that generates an audio signal, a video signal, or the like and a power amplifier circuit 84.

In the thus configured communication apparatus 80, non-reciprocal circuit devices 91 and 92 of the present embodiment are connected respectively to a path from the antenna ANT to the receiver circuit section 80R and a path from the transmission circuit section 80T to the antenna ANT. The non-reciprocal circuit device 91 functions as a circulator, and non-reciprocal circuit device 92 functions as an isolator having a terminal resistor RO.

It is apparent that the present invention is not limited to the above embodiments, but may be modified and changed without departing from the scope and spirit of the invention.

What is claimed is:

1. A non-reciprocal circuit device comprising:

a substrate including a magnetic plate having a circular surface and a dielectric ring having an annular surface, the circular surface and the annular surface being substantially coplanar;

a center conductor disposed on the substrate; and a permanent magnet that applies a magnetic field to the center conductor, wherein the center conductor includes:

a main conductor portion positioned on a straight line extending from a center of the circular surface to an outer periphery of the annular surface; and a branched conductor portion integrally formed with the main conductor portion and extending in a radial direction of the substrate from the center of the circular surface, and wherein the branched conductor portion includes:

a wide portion disposed on the circular surface; and a narrow portion having a width smaller than that of the wide portion and disposed across a boundary between the circular surface and the annular surface.

2. The non-reciprocal circuit device as claimed in claim 1, wherein the narrow portion protrudes in a radial direction from a radial edge of the wide portion.

3. The non-reciprocal circuit device as claimed in claim 2, wherein the branched conductor portion further includes a connection portion connected to the narrow portion, the connection portion being disposed on the annular surface.

4. The non-reciprocal circuit device as claimed in claim 3, wherein the connection portion has a wider width in a peripheral direction than the wide portion.

5. The non-reciprocal circuit device as claimed in claim 2, wherein the radial edge of the wide portion has first and second end portions in a peripheral direction of the substrate, and wherein the narrow portion includes first and second portions that protrude in the radial direction from the first and second end portions of the wide portion, respectively.

6. The non-reciprocal circuit device as claimed in claim 5, wherein the main conductor portion includes first, second, and third main conductor portions extending radially from the center of the circular surface at an angular interval of about 120°, wherein the wide portion includes first, second, and third wide portions extending radially from the center of the circular surface at an angular interval of about 120° so that the first, second, and third wide portions form an angle of about 60° with the first, second, and third main conductor portions, respectively, and wherein the first and second portions of the narrow portion protrude in the radial direction from the respective first and second end portions of each of the first, second, and third wide portions.

7. A communication apparatus comprising a non-reciprocal circuit device, wherein the non-reciprocal circuit device includes:

a substrate including a magnetic plate having a circular surface and a dielectric ring having an annular surface, the circular surface and the annular surface being substantially coplanar;

a center conductor disposed on the substrate; and a permanent magnet that applies a magnetic field to the center conductor, wherein the center conductor includes:

a main conductor portion positioned on a straight line extending from a center of the circular surface to an outer periphery of the annular surface; and a branched conductor portion integrally formed with the main conductor portion and extending in a radial direction of the substrate from the center of the circular surface, and wherein the branched conductor portion includes:

a wide portion disposed on the circular surface; and a narrow portion having a width smaller than that of the wide portion and disposed across a boundary between the circular surface and the annular surface.

* * * * *